US010799044B1

(12) United States Patent
Zhao

(10) Patent No.: US 10,799,044 B1
(45) Date of Patent: Oct. 13, 2020

(54) SYSTEM AND METHOD FOR HOLDING OBJECTS ON GRAPHICS FRAME

(71) Applicant: Lei Zhao, Azusa, CA (US)

(72) Inventor: Lei Zhao, Azusa, CA (US)

(73) Assignee: Lei Zhao, Azusa, CA (US)

( * ) Notice: Subject to any disclaimer, the term of this patent is extended or adjusted under 35 U.S.C. 154(b) by 0 days.

(21) Appl. No.: 16/544,759

(22) Filed: Aug. 19, 2019

(51) Int. Cl.
*A47G 1/10* (2006.01)
*A47G 1/06* (2006.01)

(52) U.S. Cl.
CPC ..... *A47G 1/101* (2019.08); *A47G 2001/0677* (2013.01)

(58) Field of Classification Search
CPC ... A47G 1/101; A47G 2001/0677; A47G 1/10
USPC ..... 403/192, 404, 205, 231
See application file for complete search history.

(56) References Cited

U.S. PATENT DOCUMENTS 4,877,213 A * 10/1989 Lambert ..... A47B 97/08 248/451
6,377,320 B1 * 4/2002 Ananian ..... G06F 1/1609 312/7.2
7,770,315 B2 * 8/2010 Bauer ..... A47G 1/02 40/209

* cited by examiner

*Primary Examiner* — Cassandra Davis
(74) *Attorney, Agent, or Firm* — Elizabeth Yang

(57) ABSTRACT

A system for holding a graphics on a graphics frame includes: a plurality of frame sections being assembled to form the graphics frame; a plurality of connectors configured to connect two vertically-arranged frame sections; wherein one of the frame sections includes two retainers received in two end portions of the frame section, wherein each of the retainers has two sliding channels; wherein each of the connectors includes at least two pairs of the protrusions and a receiving cavity for receiving the graphics; wherein one pair of the protrusions are engaged with the two of the sliding channels on one of the two retainers when the other pair of the protrusions are engaged with the two sliding channels on the other one of the two retainers to connect two vertically-arranged frame sections.

16 Claims, 6 Drawing Sheets

SYSTEM AND METHOD FOR HOLDING OBJECTS ON GRAPHICS FRAME

FIELD OF THE DISCLOSURE

The present disclosure relates to a graphic frame, and more particularly to a graphic frame with corner connectors to assemble a plurality of frame sections in a convenient, tools-free, shipping-cost saving, and time-saving method.

BACKGROUND OF THE DISCLOSURE

Generally, a variety of graphic frame structures are in use today. In order to transport the graphics, the sellers have high desire to disassemble to the graphics frame into a plurality of small-size frame components and transport the graphic frame in the form of a shipping package. In other words, after the retail purchasers receive the package, they can assemble the graphics frame to display the graphics thereon.

The traditional graphics frames commonly incorporate at least four frame sections which shaped at their ends to form a joint portion respectively, wherein four of the frame sections can be end-by-end connected with each other without having any connector. However, since this graphics frame is fabricated from rigid and non-deformable materials, the joint portions usually have the hassle to operate during assembling, and exerting over-strong force to assemble the graphics frame will decrease the lifespan of the graphics frames.

Also, some graphics frame comprises L-shaped brackets incorporated with the frame sections, wherein the adjacent ends of the frame sections at the graphics frame corner are secured together in a fashion through the L-shaped brackets. In this way, each leg of the L-shaped brackets can be extended along or in one of the adjacent frame sections.

Therefore, it would be desirable to provide an improved graphics frame structure in a configuration that would be manufactured at a relatively low cost and has a less complex method for assembling the graphics frame.

All referenced patents, applications, and literature are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a system for holding a graphic on a graphics frame comprises a plurality of frame sections for being assembled into the graphics frame; a plurality of connectors configured to connect two vertically-arranged frame sections; wherein one of the frame sections comprises two retainers received in two end portions of the frame section, wherein each of the retainers has two sliding channels; wherein each of the connectors comprises at least two pairs of the protrusions; wherein one pair of the protrusions are engaged with the two of the sliding channels on one of the two retainers when the other pair of the protrusions are engaged with the two sliding channels on the other one of the two retainers to connect two vertically-arranged frame sections.

In another aspect combinable with the general implementation, two vertical and two horizontal frame sections are vertically-connected to form a square or rectangular shape of the graphics frame.

In another aspect combinable with the general implementation, at least one of the connectors comprises a main body having two exposed surfaces and two engaging surfaces, wherein the at least two pairs of the retaining portions are arranged on the two engaging surfaces.

In another aspect combinable with the general implementation, at least one of the main body is a square shape.

In another aspect combinable with the general implementation, at least one of the engaged surfaces comprises a pair of connector heights and a pair of connector widths, wherein the engaged surfaces are configured to engage with the frame sections.

In another aspect combinable with the general implementation, at least one of the frame sections comprises two frame engaged surfaces, wherein each of the frame engaged surfaces comprises a frame height and a frame width, wherein a length of the frame height matches with a length of the connector height, and a length of the frame width matches with a length of the connector width.

In another aspect combinable with the general implementation, when four of the frame sections connected with each other, no elements is exposed, wherein the two pairs of retainers are disposed inside the frame sections.

In another aspect combinable with the general implementation, at least one of the frame sections comprises a receiving slot configured to hold a graphic on the frame sections.

In another aspect combinable with the general implementation, at least one of the connectors comprises a pair of corresponding receiving slots aligned with the frame sections while the frame sections are connected with the connectors.

In another aspect combinable with the general implementation, at least one of the connectors comprises a receiving cavity for receiving a portion of the graphics for retaining the graphic on the graphics frame.

Another aspect of the embodiment is directed to methods of holding a graphic on a graphics frame, wherein the method comprises steps of: providing a plurality of frame sections, wherein each of the frame sections comprises two retainers having two sliding channels respectively and a receiving slot; providing a plurality of connectors configured to connect the frame sections to form the graphic frame, wherein each of the connectors has a pair of corresponding receiving slots; engaging two pairs of protrusions on each of the connectors with the two sliding channels on the retainer; embedding a portion of the graphic inside the receiving slot for securing the graphic on the graphics frame.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example, operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

Figure 1:
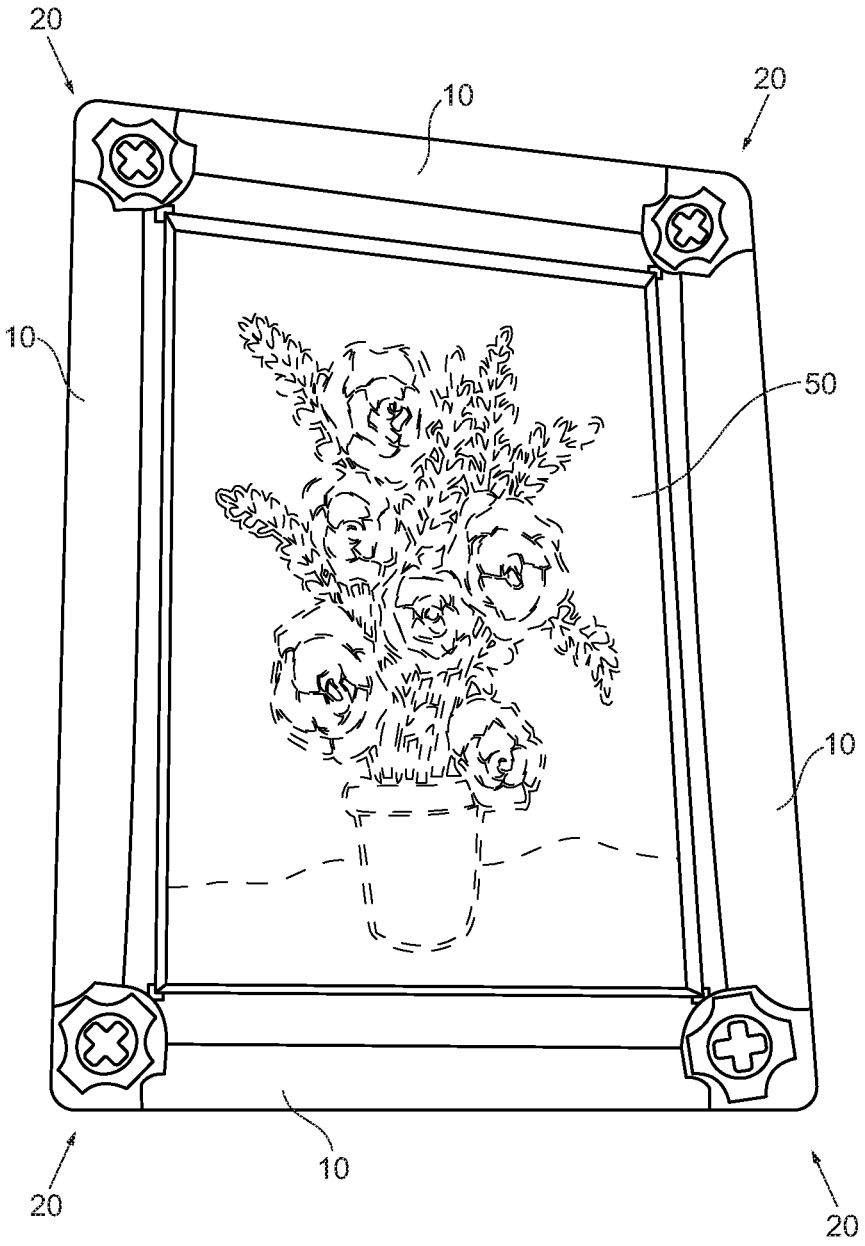
FIG. 1 is a perspective view of a system for holding a graphics according to an aspect of the embodiment, illustrating the graphics securing on the system.

FIG. 1 generally depicts the basic architecture of a system of holding a graphics 50 on a graphics frame in accordance with one of the disclosed embodiments.

Figure 2:
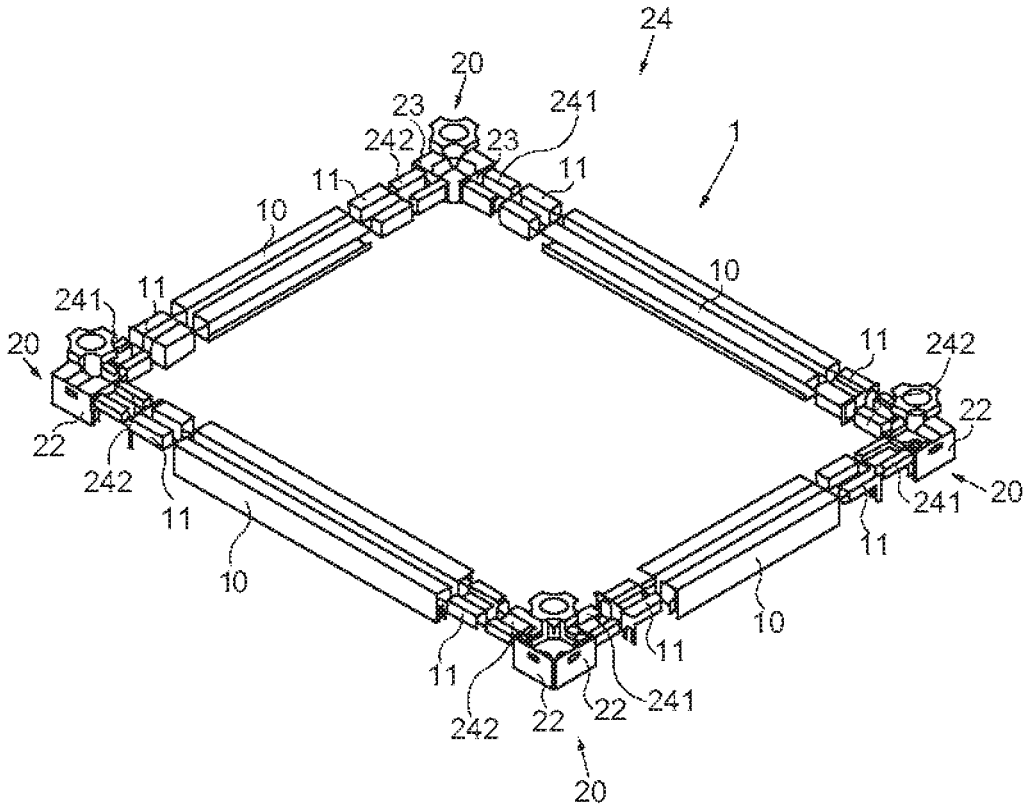
FIG. 2 is an exploded view of the system for holding the graphics according to the above-mentioned aspect of the embodiment.

Referring now to the details of FIG. 2, the system comprises a plurality of frame sections 10 and a plurality of connectors 20, wherein each of the connectors 20 is configured to connect two vertically-arranged frames sections 10, wherein four frame sections 10 can be assembled with each other to form a graphics frame 1.

In one embodiment, each of two of the frame sections 10 is vertically arranged and connected end-by-end through one connector 20. Therefore, four connectors 20 are configured to connect four frame sections 10 to form a square shape or a rectangular shape of the graphics frame 1.

As shown further in FIG. 2, each of the frame sections 10 comprises two retainers 11 received inside two end portions of the frame section 10, wherein optionally there are eight retainers 11 separately received inside the four frame sections 10 to assembly with four connectors 20 respectively. In this manner, each of the two retainers of the eight retainers 11 are received inside two end portions of the frame section 10.

Figure 3:
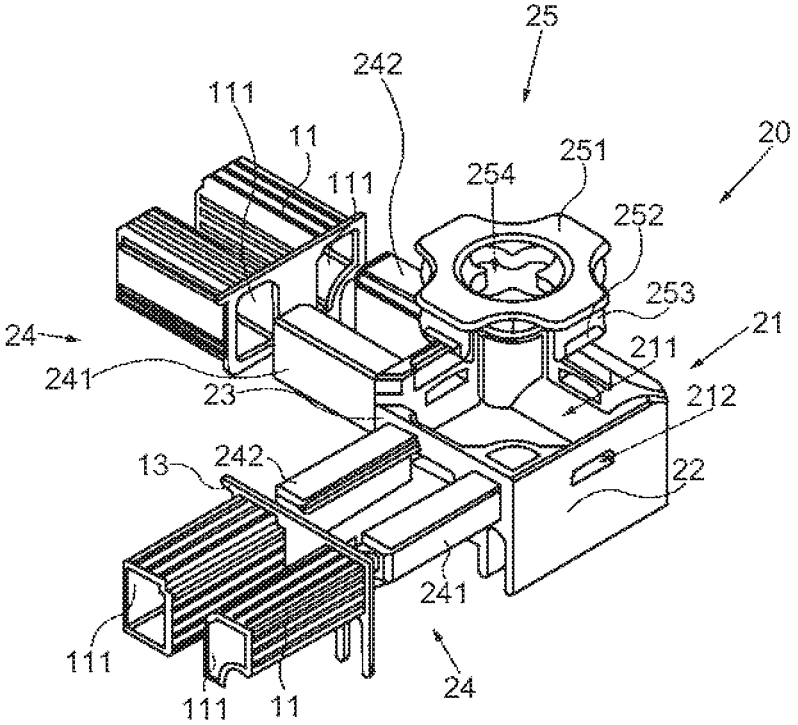
FIG. 3 is an exploded view of a connector of the system for holding the graphics according to the above-mentioned aspect of the embodiment.
Figure 9:
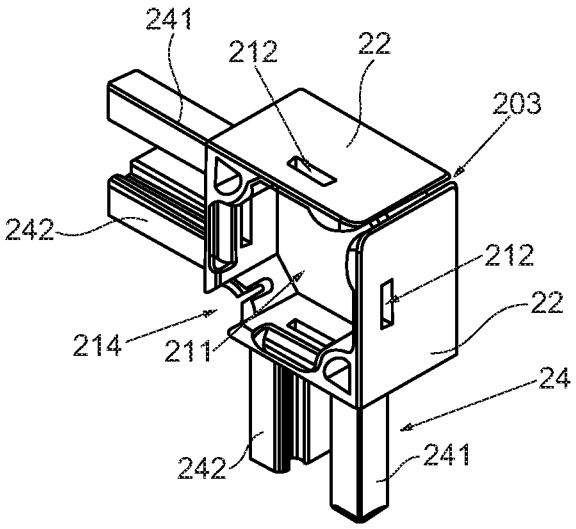
FIG. 9 is another exploded view of the connector of the system for holding the graphics according to the above-mentioned aspect of the embodiment.
Figure 10:
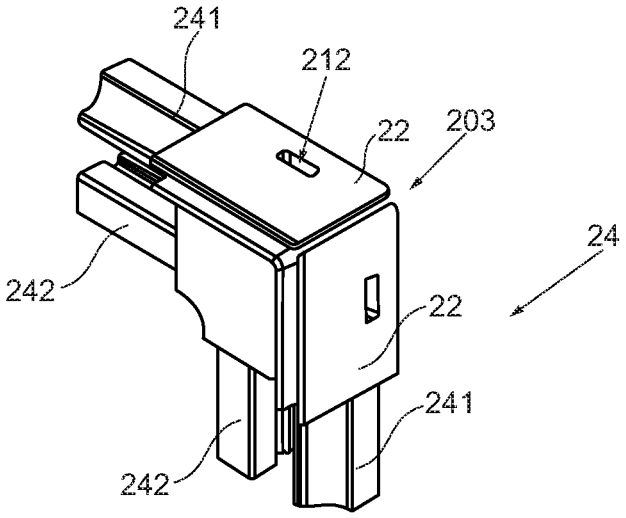
FIG. 10 is a rear view of the connector of the system for holding the graphics according to the above-mentioned aspect of the embodiment.
Figure 11:
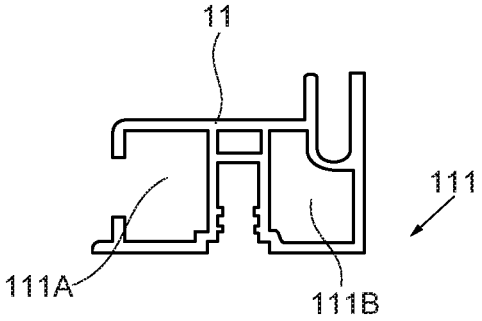
FIG. 11 is a graphical representation of a side view of the retainer of the system for holding the graphics according to the above-mentioned aspect of the embodiment.

Referring now to the detail of FIG. 2, FIG. 3 and FIG. 9, each of the connectors 20 comprises a main body 21 having two adjacently-arranged exposed surfaces 22 and two adjacently-arranged engaging surfaces 23, and two pairs of protrusions 24 arranged on the two engaging surfaces 23 respectively, wherein the main body 21 is a square shape.

In one embodiment, each pair of protrusions 24 comprises a first protrusion 241 and a second protrusion 242 parallelly arranged with the first protrusion 241, wherein each of the retainers 11 comprises two sliding channels 111 to receive the pair of the protrusions 24.

For example, one pair of two pairs of the protrusions 24 on the connector 20 is engaged with two sliding channels 111 on one of the retainers 11 received inside one frame sections 10, and the other pair of the two pairs of the protrusions 24 on the connector 20 is engaged with two sliding channels 111 on the other one of the retainers 11 received inside the other one of the frame sections 10, wherein the one frame section 10 and the other one of the frame section 10 are vertically arranged to form a 90 degrees.

Referring now to the details of FIG. 3, the two sliding channels 111 formed on the retainer 11 are not identical, wherein one of the two sliding channels 111 are shaped to engage with the first protrusion 241 and the other of the two sliding channels 111 are shaped to engage with the second protrusion 242. In other words, the two sliding channels 111 formed on the retainers 11 are identical and shaped to engage with the first and second protrusions 241 and 242, so in this manner, the first and second protrusions 241 and 242 are identical.

In another embodiment, each of the connectors 20 comprises a receiving cavity 211 and a corner pin 25 covered on the receiving cavity 211, and four narrow slots 212 formed on the two exposed surfaces 22 and the two engaging surfaces 23 respectively.

The cover pin 25 comprises a central hole 254, four downwardly extended locking arms 253, four outwardly extended locking elements 252 formed on the four downwardly extended locking arms 253 respectively, wherein the locking elements 252 are configured to lock into the narrow slots 212 while the cover pin 25 can be covered on the receiving cavity 211.

In this way, the cover pin 25 can be removed from the connector 20 through pulling the cover pin 25 through the central hole 254. In other words, the user can use a tool or a finger to place through the central hole 254 and to hook on the cover pin 25 for removing it off.

Figure 4:
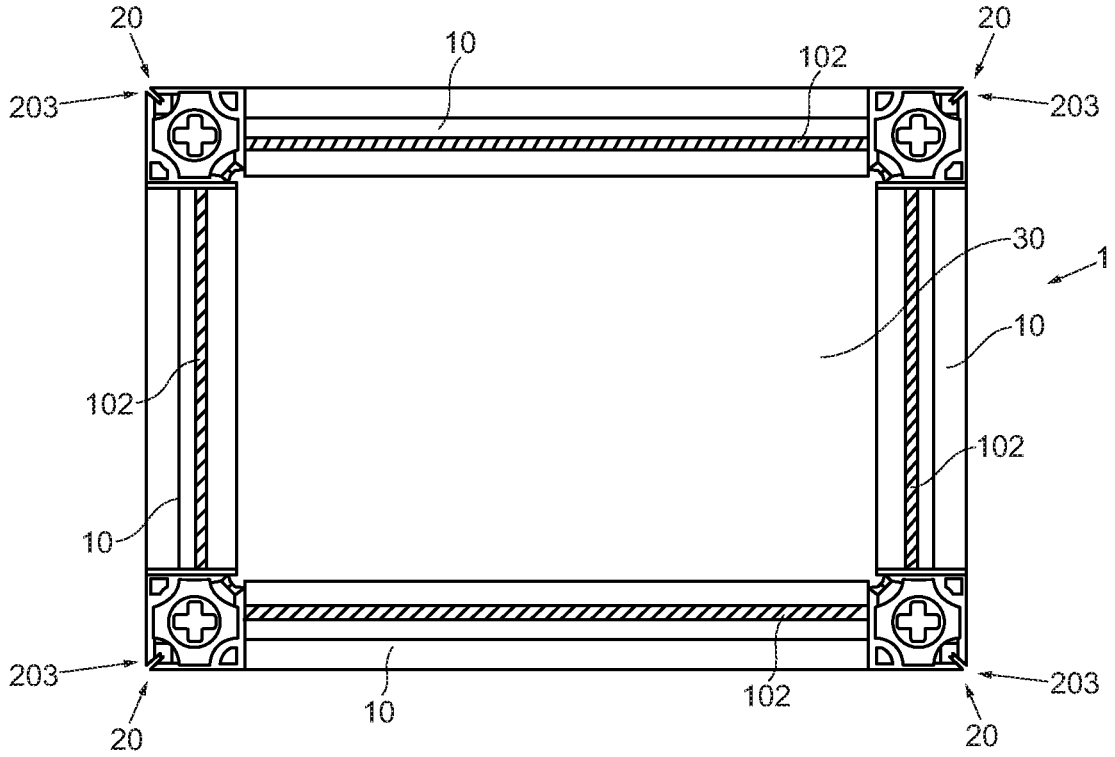
FIG. 4 is a front view of the system for holding the graphics according to the above-mentioned aspect of the embodiment.

As shown further in FIG. 4, each of the two engaging surfaces 23 has a length and a width, and each of the frame sections 10 has a frame width and a frame height, wherein the length of the engaging surface 23 is the same as the frame width, and the width of the engaging surface 23 matches with the frame height.

Figure 5:
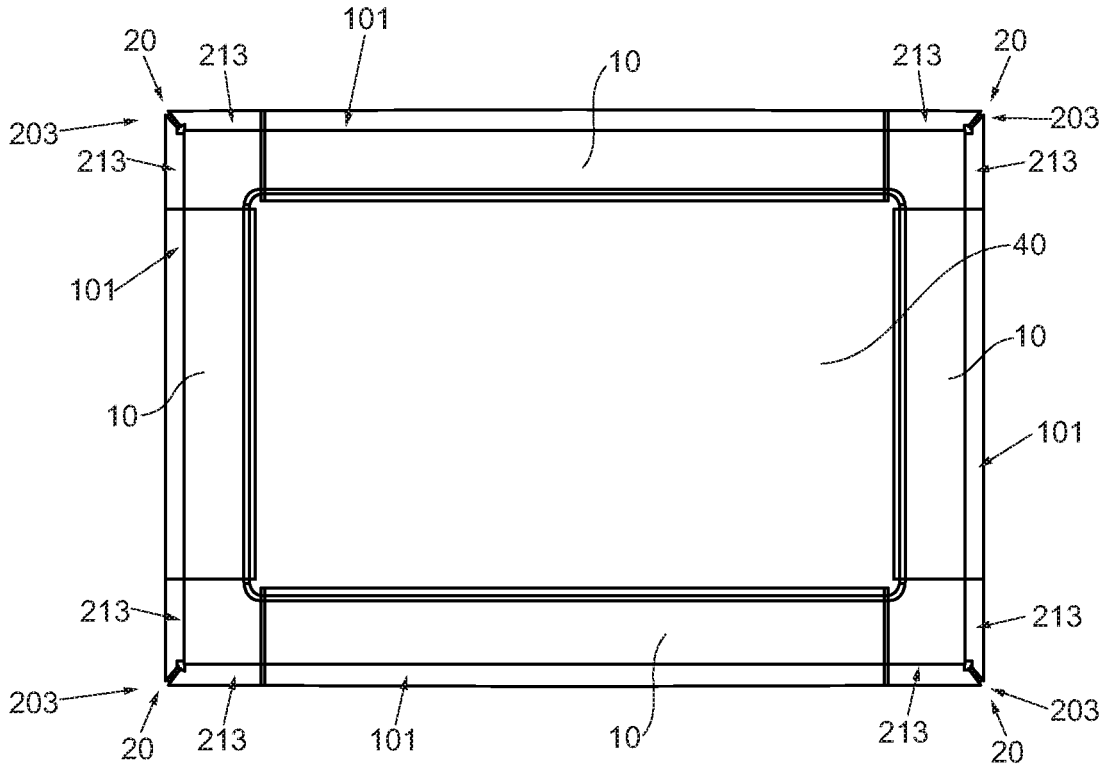
FIG. 5 is a rear view of the system for holding the graphics according to the above-mentioned aspect of the embodiment.
Figure 6:
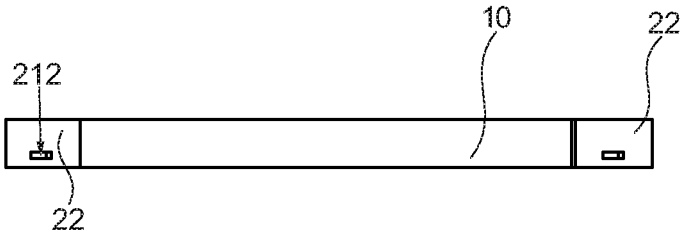
FIG. 6 is a side view of the system for holding the graphics according to the above-mentioned aspect of the embodiment.

In the embodiment of FIG. 4 and FIG. 5, four of the frame sections 10 are connected with each other through four connectors 20, wherein the protrusions 24 formed on the connectors 20 can be embedded inside the retainers 11 received inside the frame sections 10. Therefore, the four frame sections 10 can be connected by the four connectors 20 to form the graphics frame 1, and no exposed elements are shown in the present invention.

It is worth mentioning that the two retainers 11 can be received on two end portions of the frame sections 10.

Referring now to the details of FIG. 4 and FIG. 5, one connector 20 are adopted to connect two frame sections 10, so four connectors 20 are adopted to connect four frame sections 10 to form a rectangular shape graphics frame 1, wherein the four connectors 20 and the four frame sections 10 are connected with each other to form a front surface 40 and a rear surface 30.

In one embodiment, as shown in FIG. 4, the graphics 50 are shown on the front surface 30 while parts of the graphics 50 can be affixed on the sear surface 30, wherein parts of the graphics 50 are received inside the receiving cavity 211 and the corner pin 25 covered on the receiving cavity 211 with four outwardly extended locking elements 252 being locked on the four narrow slots 212 formed on the two exposed surfaces 22 and the two engaging surfaces 23.

Referring now to the details of FIG. 5, each of the frame sections 10 comprises a receiving slot 101 formed on the front surface 40, and each of the connectors 20 comprises a pair of corresponding slots 213 formed adjacent to the two exposed surfaces 22, wherein each of the receiving slots 101 is aligned with each of the corresponding slots 213 on the connectors 20, so that the receiving slots 101 and the corresponding slots 213 are aligned to form a peripheral receiving slot formed along a periphery of the graphics frame 1. According to this manner, the graphics 50 are shown on the front surface 40, and a periphery of the graphics 50 are embedded inside the receiving slots 101 and the corresponding slots 213 to affix the graphics 50 on the graphics frame 1.

In yet another embodiment, each of the frame sections 10 further comprises an adhesive liner 102, wherein the graphics 50 can be adhered on the frame section 10 through the adhesive liner 102, so as to secure the graphics on the frame sections 10.

In other words, each of the receiving slots 101 and the corresponding slots 213 are formed on an external periphery of the graphics frame 1.

Figure 7:
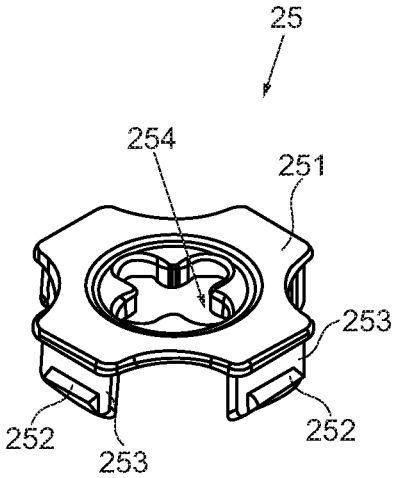
FIG. 7 is a sectional view of a cover pin of a connector of the system for holding the graphics according to the above-mentioned aspect of the embodiment.

The corner pin 25 of FIG. 7 optionally includes a central body 251 having the central hole 254 formed thereon, wherein the central body 251 is a cross-shaped body where the four locking arms 253 can be downwardly extended from four ends of the cross-shaped central body 251.

Figure 8:
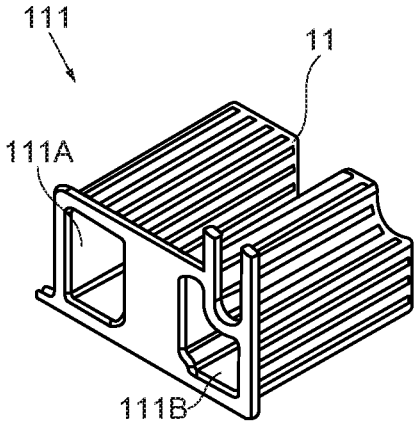
FIG. 8 is a sectional view of a retainer of the system for holding the graphics according to the above-mentioned aspect of the embodiment.

FIG. 8 illustrates that the retainer 11 comprises the two sliding channels 111, wherein the two sliding channels 111 are not identical. In other words, one of the two sliding channels 111A is a rectangular elongated sliding channel, and the other one of the two sliding channels 111B has an inwardly extended groove to comply with the receiving slots 101 of the frame sections 10.

Referring to FIG. 9 of the drawings, each of the connectors 20 further comprises a first receiving gap 203 formed between the two exposed surfaces 22 and a second receiving gap 214 formed between the two engaging surfaces 23, wherein parts of the graphics 50 can be embedded inside the receiving cavity 211 through the first receiving gap 203 and the second receiving gap 214. Accordingly, a supplemental tool can be utilized to pass through the first receiving gap 203 and the second receiving gap 214 to embed the graphics 50 inside the receiving cavity 211, and then the cover pin 25 can be covered on the receiving cavity 211 to affix the graphics 50. In other words, the first receiving gap 203 and the second receiving gap 214 are formed on the main body 21 to facilitate the user to embed the parts of graphics 50 inside the receiving cavity 211.

The contemplated embodiment further comprises a method for affixing a graphics 50 on a graphics frame 1, wherein the method comprises steps of:

Provide a plurality of frame sections 10, wherein each of the frame sections 10 comprises two retainers 11 having two sliding channels 111 respectively and a receiving slot 101;

Provide a plurality of connectors 20 configured to connect the frame sections 10 to form the graphics frame 1;

Engage two pairs of protrusions 24 on each of the connectors 20 with the two sliding channels 111 on the retainer 11;

Embed parts of the graphics 50 inside the receiving slot 101 for securing the graphics 50 on the graphics frame 1;

Provide a receiving cavity 211 on each of the connectors 20 to receive the graphics 50.

Accordingly, each of the frame sections 10 comprises two retainers 11 received inside two end portions of the frame section 10, wherein optionally there are eight retainers 11 separately received inside the four frame sections 10 to assembly with four connectors 20 respectively.

Accordingly, each of the connectors 20 comprises a main body 21 having two adjacently-arranged exposed surfaces 22 and two adjacently-arranged engaging surfaces 23, and two pairs of protrusions 24 arranged on the two engaging surfaces 23 respectively, wherein each pair of protrusions 24 comprises a first protrusion 241 and a second protrusion 242 parallelly arranged with the first protrusion 241, wherein each of the retainers 11 comprises two sliding channels 111 to receive the pair of the protrusions 24.

Therefore, the method further comprises a step of:

Engage the pair of protrusions 24 with the two sliding channels 111 of the retainer 11, so as to connect the frame sections 10 by the connector 20.

Alternatively, the method further comprises steps of:

Embed a corresponding part of the graphics 50 inside a receiving cavity 211 on the connector 20;

Cover a corner pin 25 on the receiving cavity 211 to secure the graphics 50 on the frame sections 10.

Accordingly, the frame sections 10 and the connectors 20 define a front surface 40 and a rear surface 30 while the frame sections 10 and the connectors 20 are connected with each other to form the graphics frame 1, wherein the front surface 40 has the receiving slots 101 on the frame sections 10 and the corresponding slot 213 on the connectors 20. On the other hands, the rear surface 30 has the receiving cavity 211.

In one aspect, the method further comprises a step of:

Place the graphics 50 on the front surface 40;

Overlap peripheral portions of the graphics 50 on the rear surface 30 of the frame section 10;

Force corresponding portions of the graphics 50 to embed inside the receiving cavity 211;

Insert parts of the graphics 50 inside the receiving cavity 211 through the first receiving gaps 203;

Fasten a corner pin 25 on the receiving cavity 211 to lock the graphics 50 on the frame sections 10.

The frame section 10 also optionally includes an adhesive liner 102 configured to adhere the graphics 50 to the graphics frame 1, wherein the adhesive liner 102 is formed on a periphery of the graphics frame 1.

In another aspect, the cover pin 25 is a hollow structure to facilitate the cover pin 25 being removed from the connector 20, wherein the cover pin 25 comprises a central body 251 having a central hole 254 formed thereon, wherein the user can use place certain tools or hands/fingers throughout the central hole 254, and then pull out the central body 251 from the connector 20.

In another embodiment, the connector 20 can be hanged on a wall through the central hole 254. As one example, the central hole 254 can be coupled with a screw on the wall to suspend the graphic frame 1 on the wall. Alternatively, two of the central holes 254 of the two connectors 20 can be hooked on two screws on the wall to suspend the graphics frame 1 on the wall.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more or different elements, which are disclosed herein even when not initially claimed in such combinations.

Thus, specific embodiments and applications of a system to secure a graphics on a graphics frame have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims, therefore, include not only the combination of elements which are literally set forth but all equivalent structure, material or acts for performing substantially the same function in substantially the same way to obtain substantially the same result. In this sense, it is therefore contemplated that an equivalent substitution of two or more elements may be made for anyone of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A system for holding a graphics on a graphics frame, comprising:

a plurality of frame sections being assembled to form the graphics frame;

a plurality of connectors configured to connect two vertically-arranged frame sections:

wherein one of the frame sections comprises two retainers received in two end portions of the frame section, wherein each of the retainers has two sliding channels;

wherein each of the connectors comprises at least two pairs of the protrusions and a receiving cavity for receiving the graphics;

wherein one pair of the protrusions are engaged with the two of the sliding channels on one of the two retainers when the other pair of the protrusions are engaged with the two sliding channels on the other one of the two retainers to connect two vertically-arranged frame sections.

2. The frame, as recited in claim 1, wherein two vertical and two horizontal frame sections are vertically-connected to form a square or rectangular shape of the graphics frame.

3. The frame, as recited in claim 1, wherein each of the connectors comprises a main body having two exposed surfaces and two engaging surfaces, wherein the two pairs of the protrusions are arranged on the two engaging surfaces respectively.

4. The frame, as recited in claim 3, wherein each of the engaged surfaces is engaged with at least one of the frame sections while the protrusions are received inside the retainers in the frame sections.

5. The frame, as recited in claim 4, wherein two frame sections are connected with each other by one connector, and four frame sections are connected by four connectors to form the square or rectangular shape of the graphics frame.

6. The frame, as recited in claim 5, wherein each of the connectors further comprises a corner pin covered on the receiving cavity, and four narrow slots formed on the two exposed surfaces and the two engaging surfaces respectively.

7. The frame, recited in claim 6, wherein the cover pin comprises four downwardly extended locking arms, four outwardly extended locking elements formed on the four downwardly extended locking arms to lock into the narrow slots while the cover pin covers on the receiving cavity.

8. The frame, as recited in claim 7, wherein each of the frame sections comprises a receiving slot where parts of graphics can be embedded therein.

9. The frame, as recited in claim 1, wherein the main body of the connectors is a hollow.

10. A method for holding a graphics on a graphics frame, comprising providing a plurality of frame sections, wherein each of the frame sections comprises two retainers having two sliding channels respectively and a receiving slot;

providing a plurality of connectors to connect with the frame sections;

engaging two pairs of protrusions on each of the connectors with two pairs of sliding channels on the two retainers received inside the two frame sections;

embedding the graphics inside the receiving slot for securing the graphics on the graphic frame;

providing a receiving cavity on each of the connectors to receive the graphics.

11. The method of claim 10 wherein the frame sections and the connectors define a front surface and a rear surface while the frame sections and the connectors are connected with each other to form the graphics frame.

12. The method of claim 11, further comprising placing the graphics on the front surface and parts of the graphics are overlapped on the rear surface of the frame section.

13. The method of claim 12, further adhering the graphics to an adhesive line formed on a periphery of the graphics frame.

14. The method of claim 12, wherein each of the connectors further comprises a corner pin covered on the receiving cavity, and four narrow slots formed on two exposed surfaces and two engaging surfaces respectively.

15. The method, recited in claim 14, further comprising a step of covering the cover pin on the receiving cavity to fasten the graphics on the graphics frame.

16. The method of claim 14, wherein the two retainers are received inside two end portions of the frame section, respectively.

* * * * *